US009854865B2

(12) United States Patent
Siklosi et al.

(10) Patent No.: US 9,854,865 B2
(45) Date of Patent: Jan. 2, 2018

(54) PROTECTIVE HEADGEAR

(71) Applicant: Century, LLC, Oklahoma City, OK (US)

(72) Inventors: Tibor Siklosi, Norman, OK (US); Shaw Furukawa, Oklahoma City, OK (US); Jeffrey Woodson, Choctaw, OK (US)

(73) Assignee: Century, LLC, Oklahoma City, OK (US)

( * ) Notice: Subject to any disclaimer, the term of this patent is extended or adjusted under 35 U.S.C. 154(b) by 417 days.

(21) Appl. No.: 14/033,840

(22) Filed: Sep. 23, 2013

(65) Prior Publication Data

US 2014/0090153 A1 Apr. 3, 2014

Related U.S. Application Data

(60) Provisional application No. 61/709,341, filed on Oct. 3, 2012.

(51) Int. Cl.

| | |
|---|---|
| ***A42B 3/00*** | (2006.01) |
| ***A42B 3/12*** | (2006.01) |
| ***A42B 3/06*** | (2006.01) |
| ***A63B 71/10*** | (2006.01) |

(52) U.S. Cl.

CPC ..... *A42B 3/125* (2013.01); *A42B 3/063* (2013.01); *A42B 3/12* (2013.01); *A63B 71/10* (2013.01); *A63B 2244/10* (2013.01)

(58) Field of Classification Search

CPC ..... A42B 3/063; A42B 3/125; A42B 3/12; A63B 71/10

USPC .... 2/411, 425, 414, 416, 424, 421, 423, 209

See application file for complete search history.

(56) References Cited

U.S. PATENT DOCUMENTS

| | | | | | |
|---|---|---|---|---|---|
| 4,551,861 | A * | 11/1985 | Marchello | A63B 71/10 | 2/209 |
| 4,843,642 | A * | 7/1989 | Brower | A42B 3/125 | 2/414 |
| 5,012,533 | A * | 5/1991 | Raffler | A42B 3/066 | 2/420 |
| 5,504,945 | A * | 4/1996 | Purnell | A63B 71/10 | 2/209 |
| 5,544,367 | A * | 8/1996 | March, II | A42B 3/00 | 2/410 |
| 6,360,376 | B1 * | 3/2002 | Carrington | A42B 3/00 | 2/411 |

(Continued)

*Primary Examiner* — Khaled Annis
*Assistant Examiner* — Timothy K Trieu
(74) *Attorney, Agent, or Firm* — Head, Johnson, Kachigian & Wilkinson, PC

(57) ABSTRACT

Protective headgear comprising one or more plates and one or more connectors, such as an adjustable strap, connecting the plates to each other and to a user's head. Each plate comprises an inner layer, a trauma plate, and an outer layer, where the trauma plate is located between the inner layer and the outer layer. The inner layer and the outer layer may be foam, while the trauma plate may be a rigid material. The one or more plates may comprise a front plate shaped to conform to the user's forehead; a back plate shaped to conform to the back of the user's head; a right plate shaped to conform to the right side of the user's head, covering the user's right ear; a left plate shaped to conform to the left side of the user's head, covering the user's left ear; and/or a top plate shaped to conform to the top of the user's head.

11 Claims, 5 Drawing Sheets

(56) References Cited

U.S. PATENT DOCUMENTS

| | | | | |
|---|---|---|---|---|
| 6,381,760 | B1 * | 5/2002 | Lampe | A42B 3/00 2/414 |
| 6,625,820 | B1 * | 9/2003 | Lampe | A42B 3/00 2/171 |
| 6,986,168 | B2 | 1/2006 | Abelman et al. | |
| 7,188,375 | B2 * | 3/2007 | Harrington | A42B 3/324 2/183 |
| 8,713,717 | B2 * | 5/2014 | Cleva | A42B 3/04 2/171 |
| 2004/0154080 | A1 * | 8/2004 | Abelman | A42B 3/00 2/410 |

* cited by examiner

PROTECTIVE HEADGEAR

CROSS REFERENCE

This application is based on and claims priority to U.S. Patent Application No. 61/709,341 filed Oct. 3, 2012.

BACKGROUND OF THE INVENTION

Field of the Invention

This invention relates generally to protective headgear, and more particularly, but not by way of limitation, to protective headgear comprising padded plates joined by adjustable straps appropriate for use in a variety of martial arts, including mixed martial arts, boxing, and wrestling.

Description of the Related Art

Head injury is a concern in the practice of a variety of martial arts disciplines, making protective headgear desirable. Existing sparring headgear for boxing, martial arts, and mixed martial arts, however, has limitations that present discomfort, poor fit, and limited functionality.

Martial arts headgear is typically constructed of one continuous solid dipped foam construction, with no adjustment capability. Consequently, the user is unable to adjust dipped foam headgear aside from size selection, which drastically limits both fit and functional performance. The slick rubber surface of dipped foam does not breathe, promoting heat and perspiration. Consequently, the combination of poor fit and wet, slippery head-to-headgear surface contact causes dipped foam headgear to easily shift when the user's headgear is struck with blows in the event of incidental contact. Dipped foam headgear users encounter the need to constantly reposition headgear during sparring practice, which is distracting and potentially dangerous. Additionally, dipped foam provides minimal impact absorption and little impact dispersal, consequently providing limited protection from incidental punches and kicks.

Boxing headgear is traditionally comprised of dense and thickly padded solid foam. While boxing headgear provides protection from linear impact from punches, the thick padded non-breathable construction is hot and uncomfortable due to the gear's cumbersome construction. Boxing headgear is in full contact with the boxer's head and is therefore hot and does not breathe or wick moisture. Boxing headgear utilizes single adjustment, typically in the rear of the head, limiting the user's ability to achieve a secure and consistent fit. Additionally, the thick padding utilized on boxing headgear is obtrusive and presents a larger striking target for the opponent. While the thickness of padding typically incorporated in boxing headgear provides some protection from linear impact, it may exacerbate the problem of glancing, angular, or rotational punches to the side of the head. Rotational impact acceleration rapidly spins the head generating damaging shear forces within the brain, which tears axons and the insulating myelin sheath resulting in concussion or traumatic brain injury.

Wrestling headgear typically offers no head, cheek, eyebrow, or forehead protection and cannot be used for sparring.

Mixed martial arts athletes have no headgear designed specifically for their discipline. MMA athletes may utilize boxing headgear strictly for standup punching and may utilize wrestling headgear for transitioning to takedown and grappling drills. No headgear on the market today effectively protects MMA athletes through the full range of their discipline, which incorporates standup punch/kick sparring, takedowns, and grappling.

Based on the foregoing, it is desirable to provide boxing, marital arts, and mixed martial arts athletes with headgear that is breathable, lightweight, and has improved visibility and a secure custom fit. It is further desirable to provide improved impact absorption as well as impact dispersal to protect the athlete from incidental contact from punches, cuts, elbow strikes, knee strikes, and kicks. It is further desirable to provide a secure, firm fit during sparring impact while remaining comfortable. Finally, it is desirable for the headgear to be minimally obtrusive, which may help reduce the degree of brain injury from angular impact acceleration.

SUMMARY OF THE INVENTION

In general, in a first aspect, the invention relates to protective headgear comprising one or more plates and one or more connectors connecting the one or more plates to each other and to a user's head. Each plate comprises an inner layer, a trauma plate, and an outer layer, where the trauma plate is located between the inner layer and the outer layer. The one or more plates may comprise a front plate shaped to conform to the user's forehead; a back plate shaped to conform to the back of the user's head; a right plate shaped to conform to the right side of the user's head, covering the user's right ear; and a left plate shaped to conform to the left side of the user's head, covering the user's left ear. Additionally, the one or more plates may comprise a top plate shaped to conform to the top of the user's head. The one or more connectors may comprise an adjustable strap.

The inner layer and the outer layer may comprise a resilient material capable of absorbing energy from an impact, such as foam. The trauma plate may comprise a rigid material capable of impact dispersal. Each of the one or more plates may have a generally preformed geometry that provides even surface contact on the user's head. The inner layer may be shaped such that it minimally contacts the user's head.

Each of the one or more plates may be independently removable from the protective headgear to provide a customized configuration. The protective headgear may further comprise a face shield.

Figure 1:
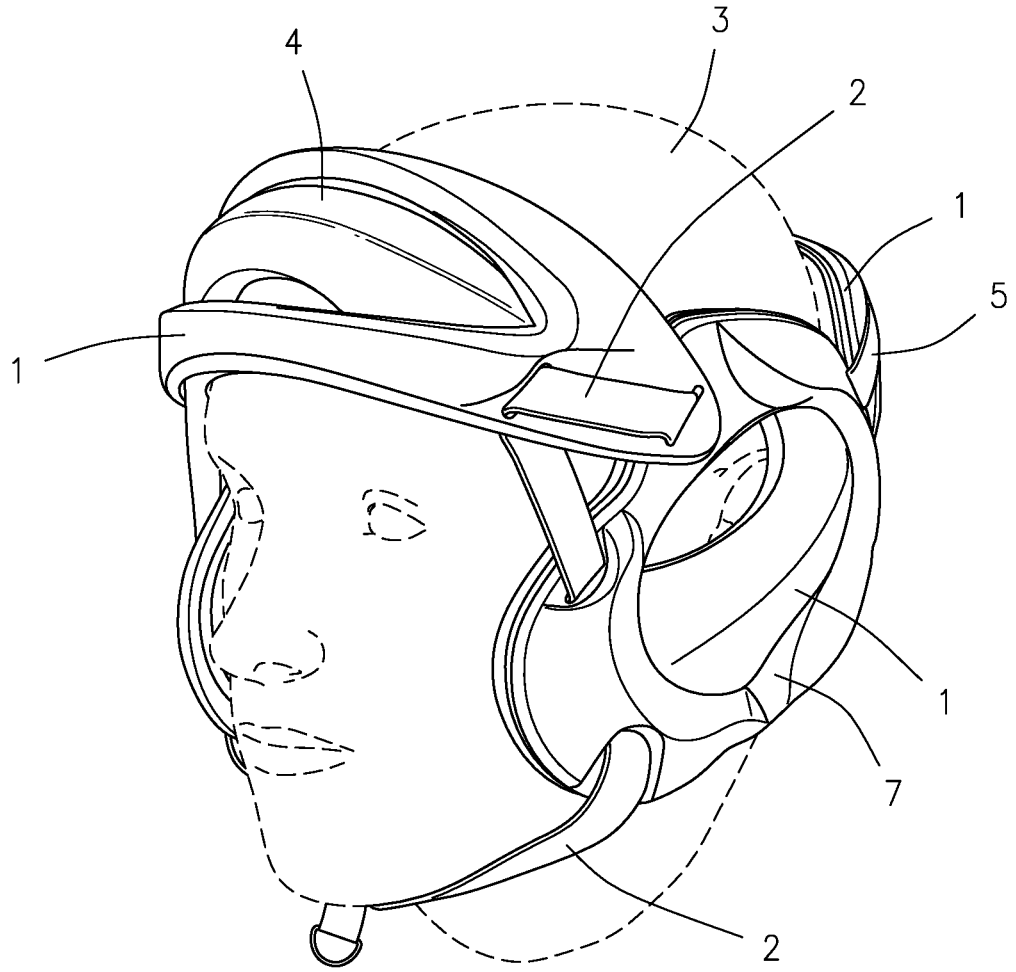
FIG. 1 is a perspective view of the protective headgear in place on a user's head.

Other advantages and features will be apparent from the following description and from the claims.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

In general, in a first aspect, the invention relates to protective headgear for use by boxing, martial arts, and mixed martial arts athletes. The headgear is breathable, lightweight, and has improved visibility and a secure custom fit. The headgear uses dual layer material technologies that combine to provide improved impact absorption as well as impact dispersal to protect the athlete from incidental contact from punches, cuts, elbow strikes, knee strikes, and kicks. Multi-faceted fitting mechanisms enable a secure fit during sparring impact while remaining comfortable. The headgear is minimally obtrusive, which may help reduce the degree of brain injury from angular impact acceleration.

The headgear, as shown in FIGS. 1 through 15, may be comprised of separate protective padded plates 1 joined by adjustable straps 2 to fit comfortably and securely around a user's head 3. The headgear may comprise four plates 1: a front plate 4, a back plate 5, a right plate 6, and a left plate 7. The plates 1 may be joined by one or more connectors, such as one or more adjustable straps 2, to enable a custom and secure fit for the athlete. The adjustable straps 2 may be multiple straps, or may be one strap threaded through various apertures in the plates 1, where the strap connects to itself under the user's chin to secure the headgear to the user's head, as shown in FIGS. 1, 2, 4, and 5. A first single strap (2) passing through one or more aperture in the right plate (6), a second single strap (2) passing through one or more aperture in the left plate (7); wherein the first single strap (2) and the second single strap (2) are connected to form a single long strap (2) that passes through the one or more apertures in the right plate (6), then through the one or more right apertures in the front plate (4), then through the one or more additional apertures in the right plate (6), then through one or more apertures in the back plate (5), then through the one or more additional apertures in the left plate (7), then through the one or more left apertures in the front plate (4), then through the one or more apertures in the left plate (7) and wherein said each of the four independent plates (4, 5, 6, 7) moving freely one another and when assembling together by the single long straps.

Figure 3:
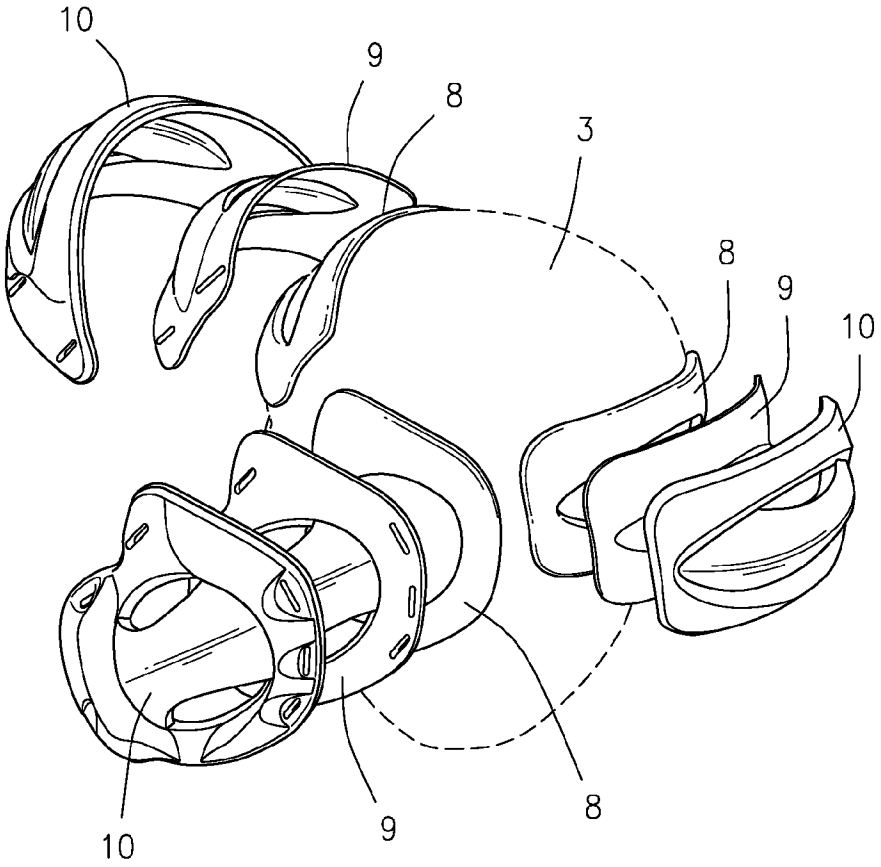
FIG. 3 is an exploded perspective view of the plates of the protective headgear.
Figure 2:
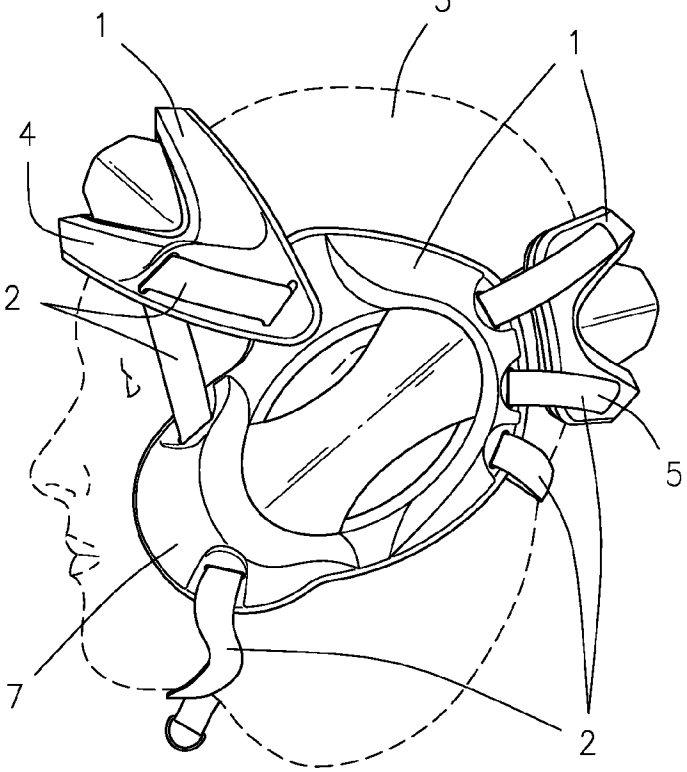
FIG. 2 is a side view of the protective headgear in place on a user's head.
Figure 5:
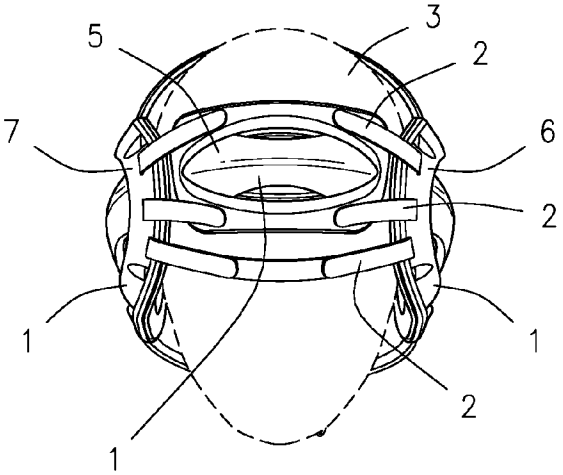
FIG. 5 is a back view of the protective headgear in place on a user's head.
Figure 7:
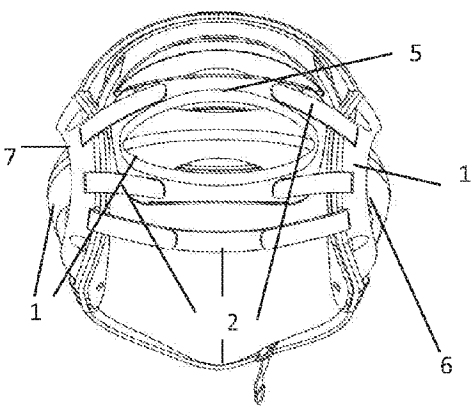
FIG. 7 is a back view of the protective headgear.
Figure 4:
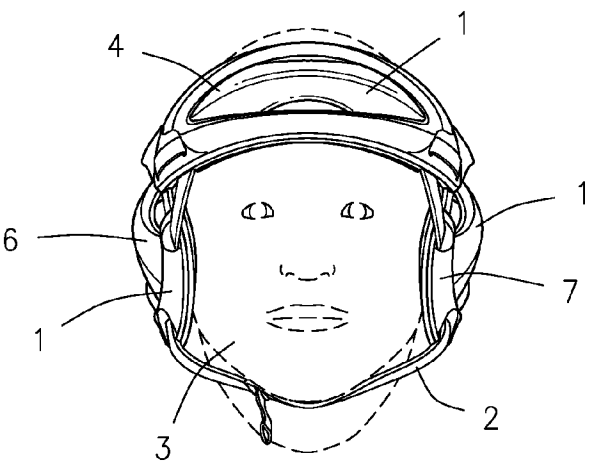
FIG. 4 is a front view of the protective headgear in place on a user's head.
Figure 6:
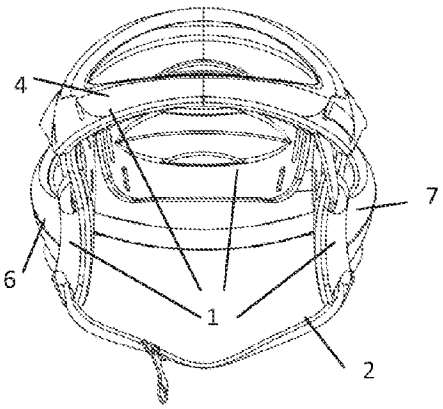
FIG. 6 is a front view of the protective headgear.
Figure 9:
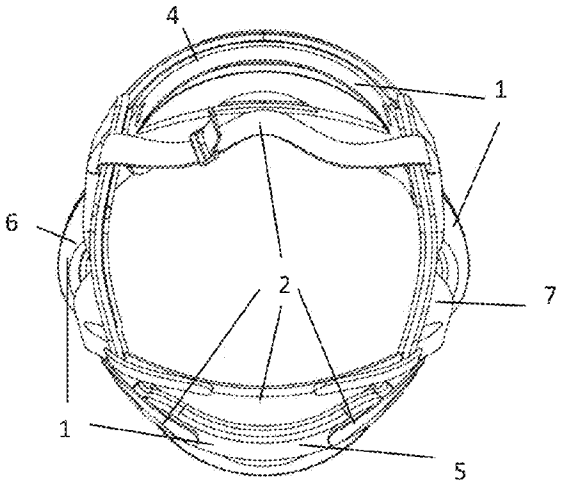
FIG. 9 is a bottom view of the protective headgear.
Figure 11:
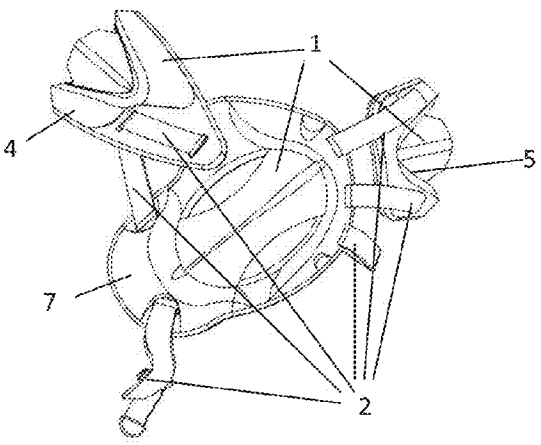
FIG. 11 is a left side view of the protective headgear.
Figure 8:
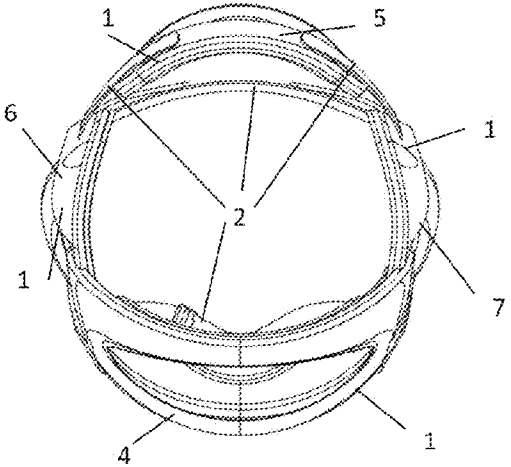
FIG. 8 is a top view of the protective headgear.
Figure 10:
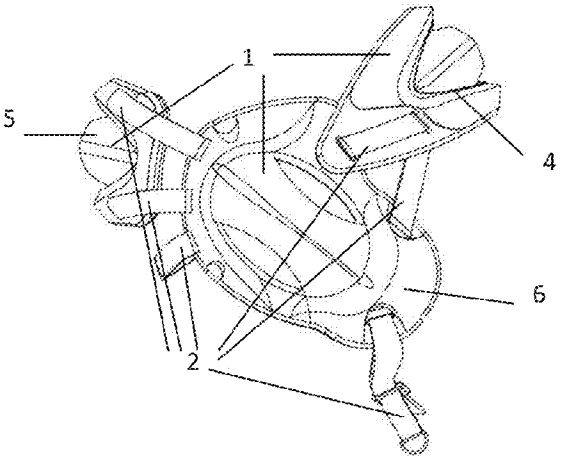
FIG. 10 is a right side view of the protective headgear.
Figure 13:
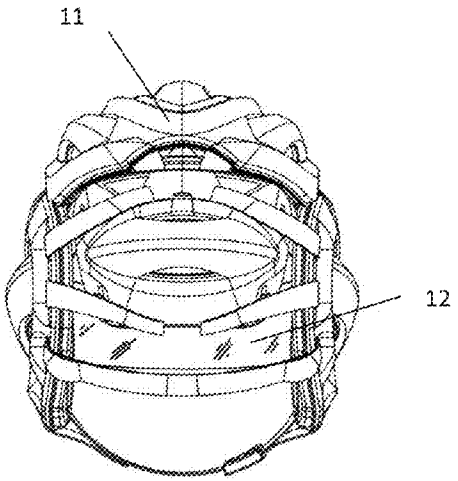
FIG. 13 is a back view of the protective headgear with optional face shield and top plate.
Figure 12:
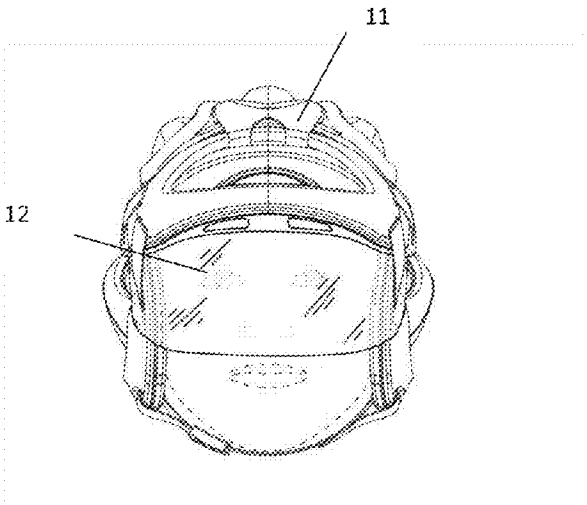
FIG. 12 is a front view of the protective headgear in place on a user's head, where the protective headgear includes optional face shield and top plate.
Figure 15:
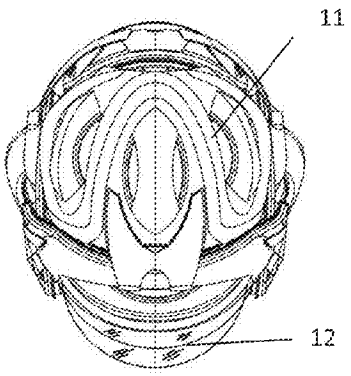
FIG. 15 is a top view of the protective headgear with optional face shield and top plate.
Figure 14:
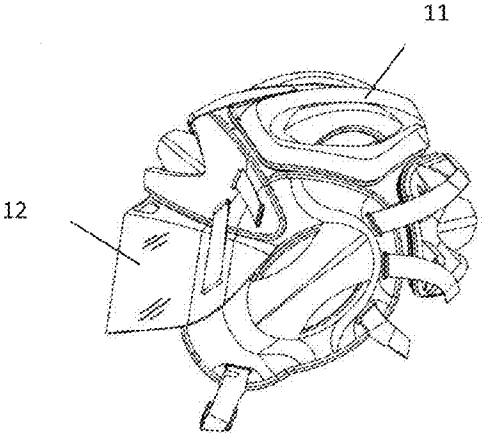
FIG. 14 is a side view of the protective headgear with optional face shield and top plate.

As shown in FIG. 3, each plate 1 may have three layers: (1) an underlayer 8, which may be made from EVA foam die cut for minimum surface contact to the user's head 3, or other appropriate material; (2) a trauma plate 9 designed to disperse impact; and (3) an outer layer 10, which may be made from EVA foam, which absorbs energy from impact. The trauma plate 9 may be sandwiched between the underlayer 8 and the outer layer 10, and may be bonded or overmolded with the outer layer 10. The trauma plate 9 may be stiff, and may be made of rigid plastic material designed to provide maximum protection for the head 3.

Each plate 1 may be designed for a particular part of the head 3 and may be of an anatomically inspired shape to effectively provide ergonomic fit and impact protection to its designated region of the head 3. Each plate 1 may feature an elevated geometric arch to effectively disperse energy at the point of impact across a broad surface area. A key advantage of the headgear is that the outer layer 10 where impacts occur is suspended from the user's head 3 generating an air space between the user's head 3 and the trauma plate 9. This design element works similar to the shell of a construction hard had, which transmits and disperses impact indirectly and away from the skull.

The lightly padded underlayer 8 beneath the trauma plate 9 may minimally contact the head 3 to promote breathability and comfortable fit. This shape enables air circulation and moisture release and therefore helps keep the headgear user cool. The internal trauma plate 9 with the padded underlayer 8 may be additionally padded on its outer surface with outer layer 10 for impact absorption to protect the user's head 3 from impact and protect the sparring opponent's hands and feet during punches and kicks, respectively.

Collectively, the assembly of the ergonomically designed independently padded plates 1 provides a sleek, unobtrusive design that minimizes the striking surface area for the sparring opponent while improving fit, functionality, and protection for the user. The relatively low profile of the headgear may minimize the occurrence of glancing blows or angular impact from incidental kicks and punches, and thereby may reduce the incidence of rapid head rotational acceleration and related brain injuries.

The headgear is functionally versatile, in that the headgear's functional characteristics may be altered for sparring or grappling disciplines by altering one or more of the padded plates 1. For instance, the back plate 5 may be removed for mixed martial arts or both the front plate 4 and the back plate 5 may be removed for wrestling applications. The headgear may be constructed such that the underlayer 8 and the outer layer 10 may have a greater thickness for beginners or children. Additionally, the headgear may incorporate one or more additional plates 1, such as a top plate 11 to cover the top of the head and/or a face shield 12 to protect the face, as shown in FIGS. 12 through 15.

The headgear may have a lightweight, breathable construction combined in a low profile design. The collection of multiple independent plates 1 incorporating internal trauma plates 5 are joined by adjustable straps, which enable a custom, secure fit. The headgear may provide head protection for sparring, boxing, and grappling. It is a versatile performance and protection solution for a variety of martial arts disciplines, mixed martial arts, boxing, and wrestling.

Whereas, the devices and methods have been described in relation to the drawings and claims, it should be understood that other and further modifications, apart from those shown or suggested herein, may be made within the spirit and scope of this invention.

What is claimed is:

1. Protective headgear comprising:

four independent plates, where each plate comprises: an inner layer; a rigid trauma plate; and an outer layer, where the trauma plate is located between the inner layer and the outer layer; and where the four independent plates comprise a front plate, a back plate, a right plate, and a left plate: and one or more straps connecting the four independent plates to each other, where the straps are configured to connect the plates to a user's head when the headgear is worn and where the plates are connected solely by the straps, the straps comprising: a first single strap passing through one or more apertures in the right plate, then through one or more right apertures in the front plate, then through one or more additional apertures in the right plate; and a second single strap passing through one or more apertures in the left plate, then through one or more left apertures in the front plate, then through one or more additional apertures in the left plate; where the first single strap and the second single strap are removably connected between the right plate and the left plate; wherein each of the plates is capable of being adjusted relative to the other plates by sliding the plate along the one or more straps and wherein the first single strap and the second single strap are connected to form a single long strap that passes through the one or more apertures in the right plate, then through the one or more right apertures in the front plate, then through the one or more additional apertures in the right plate, then through one or more apertures in the back plate, then through the one or more additional apertures in the left plate, then through the one or more left apertures in the front plate, then through the one or more apertures in the left plate; wherein said each of the four independent plates moving freely one another and when assembling together by the single long straps.

2. The protective headgear of claim 1 where the user's head has a forehead, a back, a right side with a right ear, a left side with a left ear, and a top, and where:

the front plate is shaped to conform to the user's forehead when the headgear is worn;

the back plate is shaped to conform to the back of the user's head when the headgear is worn;

the right plate is shaped to conform to the right side of the user's head when the headgear is worn, covering the user's right ear; and the left plate is shaped to conform to the left side of the user's head when the headgear is worn, covering the user's left ear.

3. The protective headgear of claim 2 further comprising a top plate shaped to conform to the top of the user's head.

4. The protective headgear of claim 1 where the inner layer and the outer layer comprise a resilient material capable of absorbing energy from an impact.

5. The protective headgear of claim 4 where the inner layer and the outer layer comprise foam.

6. The protective headgear of claim 4 where the trauma plate comprises a rigid material capable of dispersing impact.

7. The protective headgear of claim 4 where each of the four plates has a generally curved shape.

8. The protective headgear of claim 4 where at least one of the four plates comprises an arched segment.

9. The protective headgear of claim 4 where the inner layer is shaped such that the inner layer contacts the user's head only to an extent necessary to separate the trauma plate from the user's head when the headgear is worn.

10. The protective headgear of claim 4 where each of the plates is independently removable from the protective headgear to provide a customized configuration.

11. The protective headgear of claim 4 further comprising a face shield.

* * * * *